US011753052B2

(12) United States Patent
Kounoike et al.

(10) Patent No.: US 11,753,052 B2
(45) Date of Patent: Sep. 12, 2023

(54) RAILCAR BOGIE FRAME

(71) Applicant: KAWASAKI RAILCAR MANUFACTURING CO., LTD., Kobe (JP)

(72) Inventors: Fumikazu Kounoike, Kakogawa (JP); Yosuke Matsushita, Kobe (JP); Yoshihiro Tamura, Kobe (JP); Yukihiro Sano, Kobe (JP); Toshifumi Machida, Kobe (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 496 days.

(21) Appl. No.: 17/072,066

(22) Filed: Oct. 16, 2020

(65) Prior Publication Data

US 2021/0031814 A1 Feb. 4, 2021

Related U.S. Application Data

(63) Continuation of application No. PCT/JP2019/015071, filed on Apr. 5, 2019.

(30) Foreign Application Priority Data

Apr. 16, 2018 (JP) ..... 2018-078183

(51) Int. Cl.
*B61F 5/16* (2006.01)
*B61F 3/04* (2006.01)
(Continued)

(52) U.S. Cl.
CPC ..... *B61F 5/16* (2013.01); *B61F 3/04* (2013.01); *B61F 5/144* (2013.01); *B61F 5/52* (2013.01)

(58) Field of Classification Search
CPC .... B61F 5/305; B61F 5/32; B61F 5/52; B61F 5/325; B61F 5/302; B61F 5/30;
(Continued)

(56) References Cited

U.S. PATENT DOCUMENTS 1,632,077 A * 6/1927 Jablow ..... B61F 3/04 105/189
4,353,309 A * 10/1982 Pollard ..... B61F 5/48 105/182.1
(Continued)

FOREIGN PATENT DOCUMENTS

JP 2012-46069 A 3/2012
JP 4889831 B2 3/2012
(Continued)

*Primary Examiner* — Mark T Le
(74) *Attorney, Agent, or Firm* — XSENSUS LLP

(57) ABSTRACT

A bogie frame includes a cross beam extending in a car width direction and including a car width direction middle portion at which a center pin arrangement space is formed. The cross beam includes a pair of pipe members extending in the car width direction and lined up so as to be located away from each other in a car longitudinal direction, and air spring seats provided at upper surfaces of car width direction end portions of the pair of pipe members. At least one of the pair of pipe members includes a curved portion at a car width direction middle portion thereof, the curved portion projecting outward in the car longitudinal direction such that a clearance between the pair of pipe members increases. The center pin arrangement space is formed between the pair of pipe members by the curved portion.

15 Claims, 8 Drawing Sheets

(51) Int. Cl.
*B61F 5/14* (2006.01)
*B61F 5/52* (2006.01)

(58) Field of Classification Search
CPC ..... B61F 5/26; B61F 5/48; B61F 3/04; B61F 5/10; B61F 5/16; B61F 5/144
See application file for complete search history.

(56) References Cited

U.S. PATENT DOCUMENTS

| | | | | |
|---|---|---|---|---|
| 6,079,335 | A * | 6/2000 | Polley | B61F 5/26 105/34.1 |
| 2012/0318164 | A1 | 12/2012 | Shinmura et al. | |
| 2014/0123870 | A1* | 5/2014 | Nishimura | B61F 5/302 105/197.05 |

FOREIGN PATENT DOCUMENTS

| | | | |
|---|---|---|---|
| JP | 2016-203865 | A | 12/2016 |
| JP | 2017-81308 | A | 5/2017 |

* cited by examiner

RAILCAR BOGIE FRAME

CROSS-REFERENCE TO RELATED APPLICATIONS

This application is a bypass continuation of and claims priority to PCT/JP2019/015071, filed on Apr. 5, 2019, which claims priority to JP 2018-078183, filed on Apr. 16, 2018, both of which are incorporated by reference in their entirety.

TECHNICAL FIELD

The present invention relates to a bogie frame of a railcar bogie.

BACKGROUND ART

There are railcar bogie frames in each of which a cross beam is formed by a pair of steel pipes extending in a car width direction and lined up in a car longitudinal direction (see PTL 1, for example). In consideration that a center pin projecting downward from a car body is located at a car width direction middle portion of the cross beam, the pair of steel pipes are arranged away from each other in the car longitudinal direction such that an adequate gap through which the center pin can pass is formed. Air spring seats are provided on upper surfaces of car width direction end portions of the pair of steel pipes, and air springs are mounted on the air spring seats from above.

CITATION LIST

Patent Literature

PTL 1: Japanese Laid-Open Patent Application Publication No. 2017-81308

SUMMARY OF INVENTION

Technical Problem

However, when the pair of steel pipes are arranged adequately away from each other in the car longitudinal direction, the pair of steel pipes cannot support the air springs from right under the air springs. Part of downward loads from the air springs are transmitted to the pair of steel pipes through the air spring seats. However, when the pair of steel pipes largely protrude outward in the car longitudinal direction from lower end surfaces of the air springs, linear, smooth load transmission is spoiled, and the rate of the load transmitted through the air spring seats increases. In this case, the strength of the air spring seats themselves and the joining strength between the pair of steel pipes and the air spring seats need to be increased. With this, there are problems that, for example, a weight increase is caused, and joining work requires skill.

SUMMARY

A railcar bogie frame according to one aspect of the present invention includes a cross beam extending in a car width direction and including a car width direction middle portion at which a center pin arrangement space is formed. The cross beam includes a pair of pipe members extending in the car width direction and lined up so as to be located away from each other in a car longitudinal direction and air spring seats provided at upper surfaces of car width direction end portions of the pair of pipe members. At least one of the pair of pipe members includes a curved portion at a car width direction middle portion thereof, the curved portion projecting outward in the car longitudinal direction such that a clearance between the pair of pipe members increases. The center pin arrangement space is formed between the pair of pipe members by the curved portion.

According to the above configuration, the curved portion is formed at at least one of the pair of pipe members so as to be located at the car width direction middle portion of the cross beam. Therefore, a clearance between the pair of pipe members at the car width direction middle portion of the cross beam is wide, but a clearance between the pair of pipe members at each of the car width direction end portions of the cross beam is narrow. On this account, even when the center pin arrangement space is formed between the pair of pipe members at the car width direction middle portion of the cross beam, the pair of pipe members are prevented from largely protruding from the lower end surface of the air spring outward in the car longitudinal direction. Thus, smooth load transmission from the air springs to the pair of pipe members can be realized while adequately securing the center pin arrangement space.

DESCRIPTION OF EMBODIMENTS

Hereinafter, an embodiment will be described with reference to the drawings. In the following description, a direction in which a railcar travels and a car body extends is defined as a car longitudinal direction, and a lateral direction perpendicular to the car longitudinal direction is defined as a car width direction. The car longitudinal direction is also called a front-rear direction, and the car width direction is also called a left-right direction.

Figure 1:
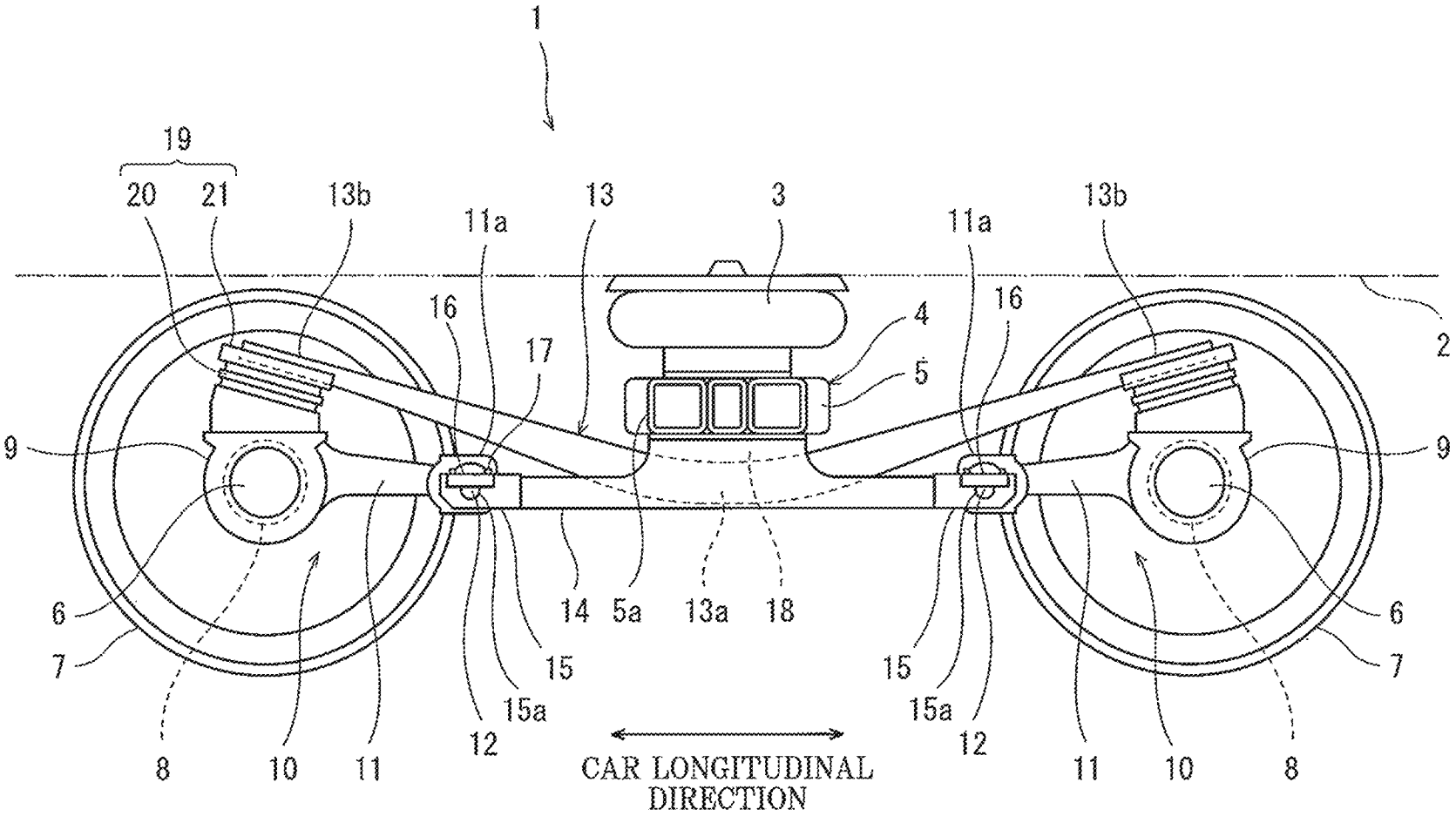
FIG. 1 is a side view of a railcar bogie according to an embodiment.

FIG. 1 is a side view of a railcar bogie 1 according to the embodiment. As shown in FIG. 1, the bogie 1 supports a car body 2 from below through air springs 3 serving as secondary suspensions. The bogie 1 includes a bogie frame 4 on which the air springs 3 are mounted. The bogie frame 4 includes a cross beam 5 extending in the car width direction but does not include side sills extending in the car longitudinal direction from car width direction end portions 5*a* of the cross beam 5. A pair of axles 6 each extending in the car width direction are arranged at both sides of the cross beam 5 in the car longitudinal direction. Wheels 7 are provided at both car width direction portions of each axle 6. Bearings 8 rotatably supporting the axle 6 are provided at both car width direction end portions of the axle 6 so as to be located outside the corresponding wheels 7 in the car width direction. The bearings 8 are accommodated in axle boxes 9.

Each car width direction end portion 5*a* of the cross beam 5 is coupled to the axle box 9 by an axle box suspension 10. The axle box suspension 10 includes an axle beam 11 extending from the axle box 9 toward the cross beam 5 in the car longitudinal direction. A tubular portion 11*a* is provided at a tip end of the axle beam 11. The tubular portion 11*a* is open toward both sides in the car width direction. A core rod 12 is inserted into an internal space of the tubular portion 11*a* so as to project from the tubular portion 11*a* toward both sides in the car width direction. An elastic bushing is interposed between the core rod 12 and the tubular portion 11*a*.

The bogie frame 4 includes receiving sills 14 each extending from the car width direction end portion 5*a* of the cross beam 5 toward both sides in the car longitudinal direction. A pair of receiving seats 15 are provided at each of tip ends of the receiving sills 14. The pair of receiving seats 15 include fitting grooves 15*a* that are recessed downward. Both end portions of the core rod 12 are fitted into the fitting grooves 15*a* from above. Both end portions of the core rod 12 accommodated in the pair of fitting grooves 15*a* are pressed by lid members 16 from above, and the lid members 16 are fixed to the receiving seats 15 by fasteners 17 (for example, bolts).

A pair of axle boxes 9 arranged away from each other in the car longitudinal direction support both longitudinal direction end portions 13*b* of a plate spring 13 extending in the car longitudinal direction. A longitudinal direction middle portion 13*a* of the plate spring 13 supports the car width direction end portion 5*a* of the cross beam 5 from below. With this, the cross beam 5 is supported by the axle boxes 9 through the plate springs 13. To be specific, the plate spring 13 has both the function of a primary suspension and the function of a conventional side sill.

The plate spring 13 has a bow shape that is convex downward in a side view. Pressing members or pressing structures 18 are provided at lower portions of the car width direction end portions 5*a* of the cross beam 5. Each of the pressing members 18 includes a circular-arc lower surface that is convex downward. The pressing members 18 are placed on and separably contact middle portions 13*a* of the plate springs 13 from above. To be specific, the plate springs 13 are not fixed to the pressing members 18 in the upper-lower direction, and the pressing members 18 contact upper surfaces of the plate springs 13 by a downward load from the cross beam 5. To be specific, each pressing member 18 is not fixed to the corresponding plate spring 13 by fixtures, and a pressing state of the pressing member 18 against the plate spring 13 is maintained by pressure generated by a gravitational downward load from the cross beam 5 and reaction force of the plate spring 13 against the downward load. With this, the plate spring 13 can swing while changing a pressing region where the plate spring 13 is pressed against a lower surface of the pressing member 18.

A supporting member or structure 19 is attached to an upper end portion of the axle box 9. The end portion 13*b* of the plate spring 13 is supported by the axle box 9 from below through the supporting member 19. An upper surface of the supporting member 19 is inclined toward a bogie middle side in a side view. The end portion 13*b* of the plate spring 13 is placed on the supporting member 19 from above without being fixed to the supporting member 19 in the upper-lower direction. The supporting member 19 includes a vibration-proof member or vibration reducing structure 20 (for example, rubber) and a receiving member or structure 21. The vibration-proof member 20 is provided on the axle box 9, and the receiving member 21 is provided on and positioned at the vibration-proof member 20.

Figure 2:
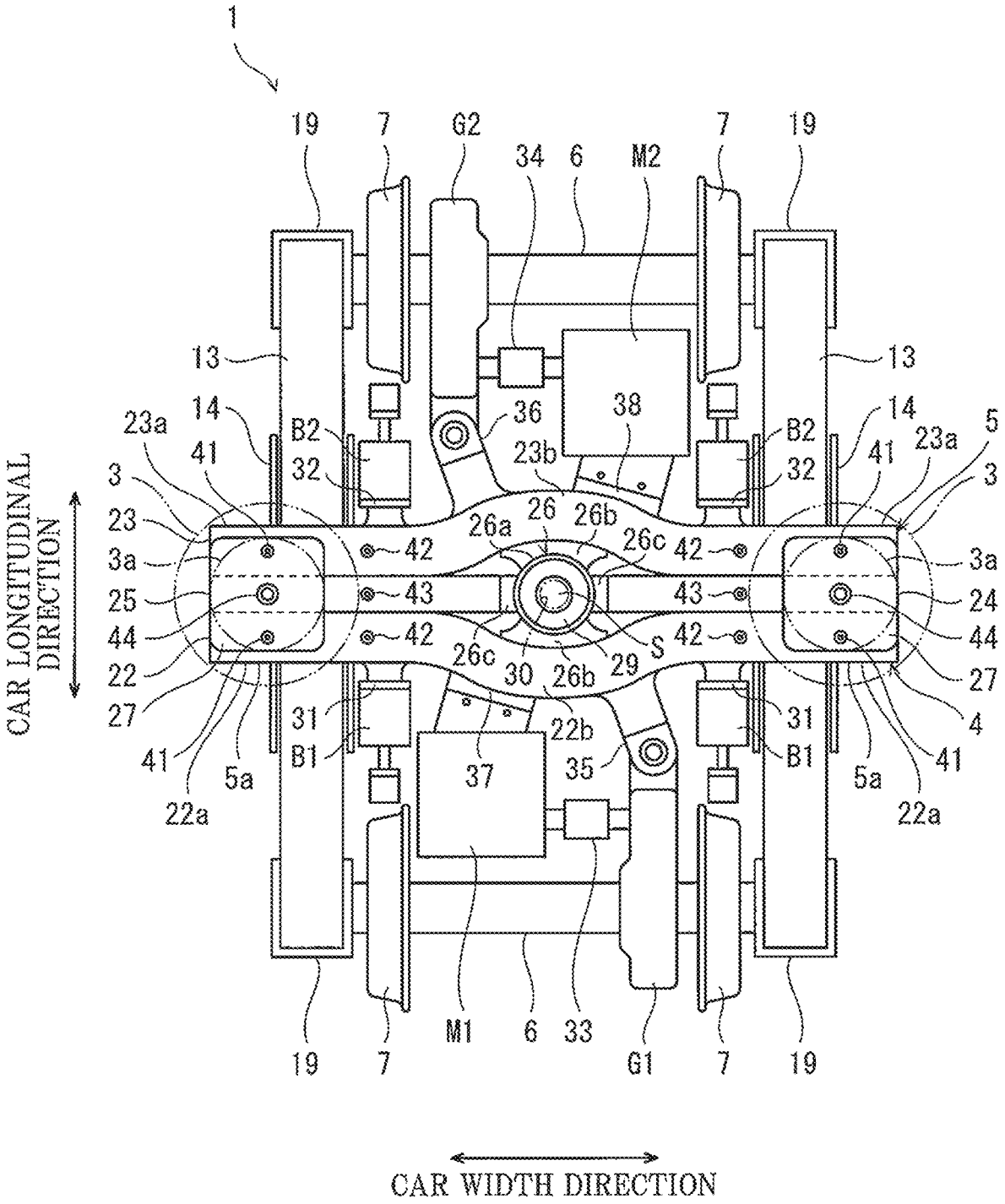
FIG. 2 is a plan view of the bogie of FIG. 1 when viewed from above.
Figure 3:
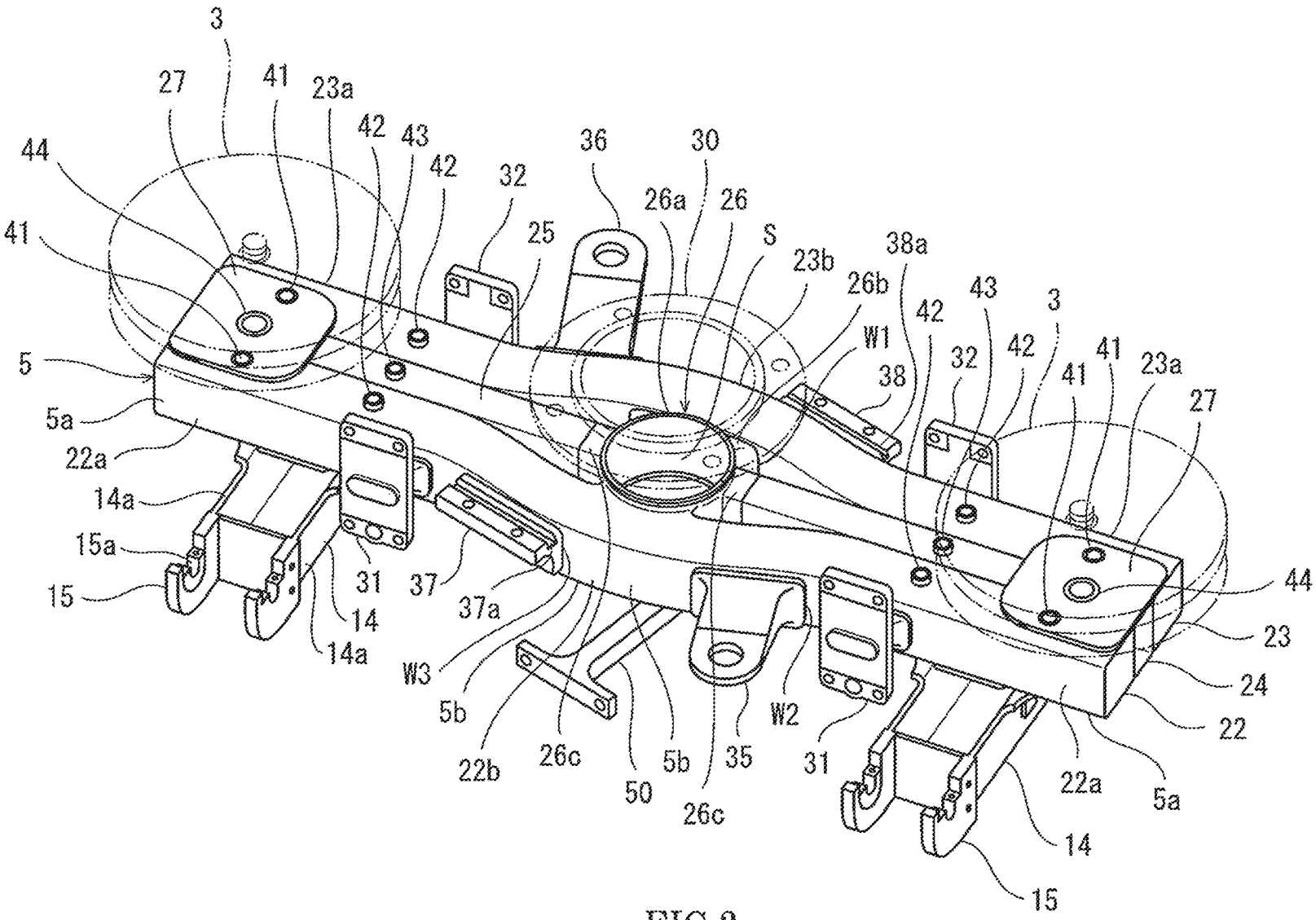
FIG. 3 is a perspective view of a bogie frame of FIG. 2 when viewed from above.
Figure 4:
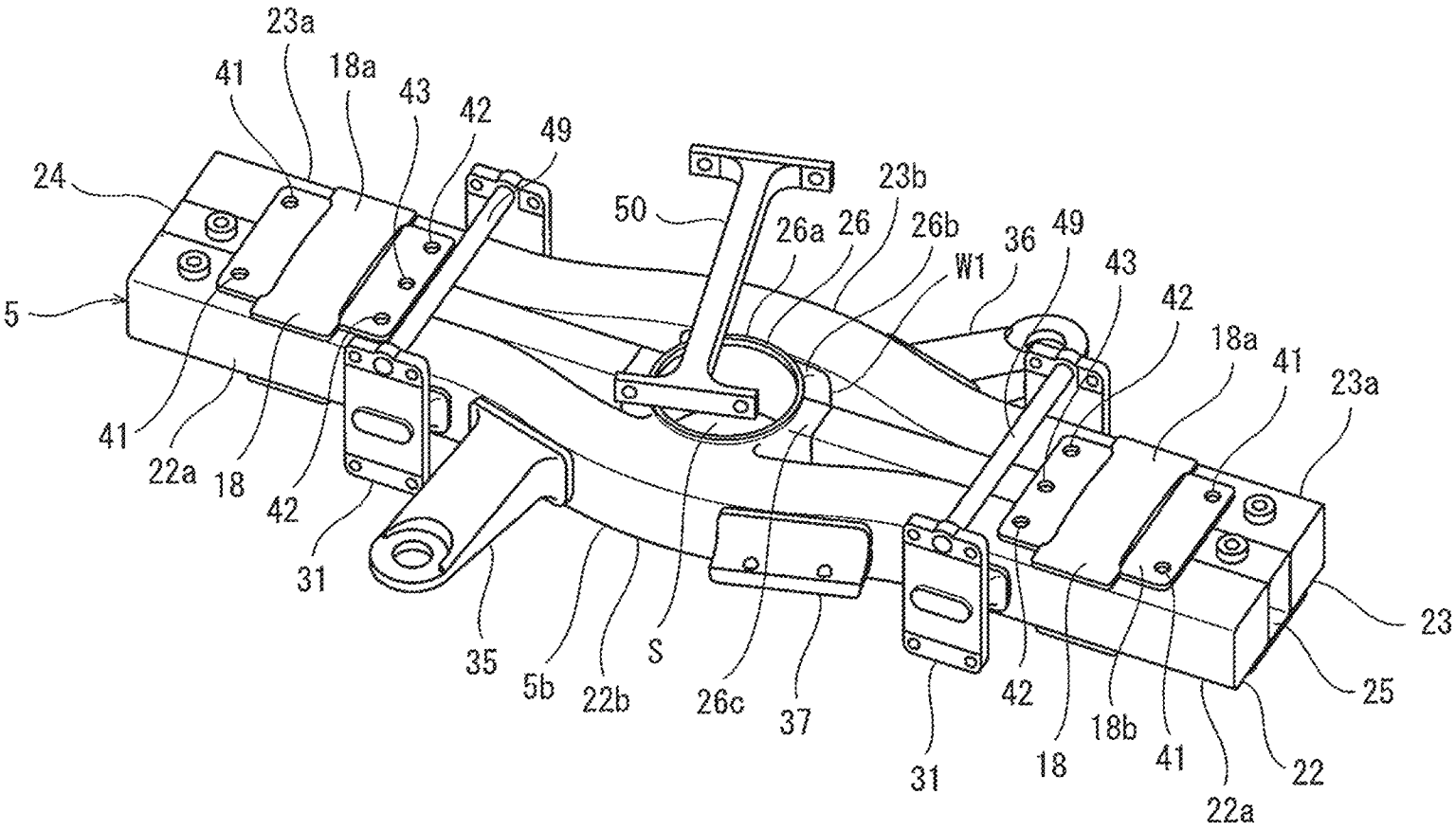
FIG. 4 is a perspective view of the bogie frame of FIG. 2 when viewed from below.

FIG. 2 is a plan view of the bogie 1 of FIG. 1 when viewed from above. FIG. 3 is a perspective view of the bogie frame 4 of FIG. 2 when viewed from above. FIG. 4 is a perspective view of the bogie frame 4 of FIG. 2 when viewed from below. As shown in FIGS. 2 to 4, the cross beam 5 extends in the car width direction, and a center pin arrangement space S is formed at a car width direction middle portion 5*b* (see FIGS. 3 and 4) of the cross beam 5. For example, the cross beam 5 is made of metal. Specifically, the cross beam 5 includes a pair of pipe members or pipes 22 and 23, a pair of intermediate members or structures 24 and 25, a center pin accommodating member or structure 26, air spring seats 27, and the pressing members 18. The pipe members or pipes 22 and 23 are a type of elongated supports.

The pair of pipe members 22 and 23 extend in the car width direction and are lined up so as to be located away from each other in the car longitudinal direction. For example, the pipe members 22 and 23 are square pipes. Internal spaces of the pipe members 22 and 23 are sealed so as to be used as auxiliary air chambers for the air springs 3. The pipe member 22 includes linear portions 22*a* and a curved portion 22*b*, and the pipe member 23 includes linear portions 23*a* and a curved portion 23*b*. The linear portions 22*a* and 23*a* are located at the car width direction end portions 5*a* of the cross beam 5 and extend linearly in the car width direction. The curved portions 22*b* and 23*b* are located at the car width direction middle portion 5*b* of the cross beam 5 and project outward in the car longitudinal direction such that a clearance between the pair of pipe members 22 and 23 increases. The center pin arrangement space S is provided at a space formed between the curved portions 22*b* and 23*b* of the pair of pipe members 22 and 23. Therefore, the car width direction end portion 5*a* of the cross beam 5 is smaller in size in the car longitudinal direction than the car width direction middle portion 5*b* of the cross beam 5. It should be noted that the internal spaces of the pipe members 22 and 23 do not have to be sealed when the internal spaces are not used as the auxiliary air chambers.

The pair of intermediate members 24 and 25 are arranged at both sides of the center pin arrangement space S in the car width direction and extend in the car width direction. Each of the intermediate members 24 and 25 is sandwiched between the linear portions 22*a* and 23*a* of the pair of pipe members 22 and 23. The pair of intermediate members 24 and 25 are located away from each other in the car width direction to form a gap at a middle of the cross beam 5. For example, the intermediate members 24 and 25 are square pipes. Internal spaces of the intermediate members 24 and 25 are sealed so as to be used as auxiliary air chambers for the air springs 3. For example, vertical sizes of the intermediate members 24 and 25 are the same as vertical sizes of the pipe members 22 and 23. For example, sizes of the intermediate members 24 and 25 in the car longitudinal direction are smaller than sizes of the pipe members 22 and 23 in the car longitudinal direction.

The center pin accommodating member 26 is arranged between the curved portions 22*b* and 23*b* of the pair of pipe members 22 and 23 and between the pair of intermediate members 24 and 25. The center pin accommodating member 26 includes a tubular portion 26*a*, a pair of longitudinal attaching portions 26*b*, and a pair of lateral attaching portions 26*c*. The tubular portion 26*a* forms the center pin arrangement space S. The pair of longitudinal attaching portions 26*b* project from the tubular portion 26*a* toward both sides in the car longitudinal direction. The pair of lateral attaching portions 26*c* project from the tubular portion 26*a* toward both sides in the car width direction. An internal space of the tubular portion 26*a* is open toward both sides in a vertical direction and serves as the center pin arrangement space S. A cylindrical elastic bushing 29 is fitted in the tubular portion 26*a*. A center pin 30 projecting downward from the car body 2 is inserted into the elastic bushing 29.

The longitudinal attaching portions 26*b* are joined to circular-arc inner side surfaces of the curved portions 22*b* and 23*b* of the pipe members 22 and 23, the inner side surfaces being located close to a center of the cross beam 5. Each of car longitudinal direction outer joining ends (tip ends) of the longitudinal attaching portions 26*b* has a circular-arc shape in a plan view. The car longitudinal direction outer joining ends (tip ends) of the longitudinal attaching portions 26*b* are joined to the inner side surfaces of the curved portions 22*b* and 23*b* by circumferential welding, the inner side surfaces being located close to the center of the cross beam 5. Each of the longitudinal attaching portions 26*b* has such a shape as to gradually spread toward the joining end thereof. With this, tractive effort acting in the car longitudinal direction can be smoothly transmitted between the pipe member 22, 23 and the center pin 30 through the center pin accommodating member 26.

Vertical sizes of the joining ends of the longitudinal attaching portions 26*b* are smaller than vertical sizes of the inner side surfaces of the curved portions 22*b* and 23*b*, the inner side surfaces being located close to the center of the cross beam 5. A welded portion W1 by which the joining end of the longitudinal attaching portion 26*b* and the curved portion 22*b* are joined to each other is provided at and within the inner side surface of the curved portion 22*b*, and another welded portion W1 by which the joining end of the longitudinal attaching portion 26*b* and the curved portion 23*b* are joined to each other is provided at and within the inner side surface of the curved portion 23*b*. Therefore, each welded portion W1 can be completed on one side surface of the curved portion 22, 23*b*, and stress generated at the welded portion W1 can be suppressed.

Car width direction outer joining ends (tip ends) of the lateral attaching portions 26*c* are joined to end edges of the intermediate members 24 and 25 by welding, the end edges being located close to the center of the cross beam 5. The joining ends of the lateral attaching portions 26*c* are the same in shape as the end edges of the intermediate members 24 and 25, the end edges being opposed to the corresponding lateral attaching portions 26*c*. The joining ends of the lateral attaching portions 26*c* are joined to the end edges of the intermediate members 24 and 25 by circumferential welding. With this, a load generated by the displacement of the center pin 30 in the left-right direction (car width direction) is transmitted through the center pin accommodating member 26 to the intermediate members 24 and 25, and the intermediate members 24 and 25 suitably inhibit an excessive movement of the center pin 30 in the left-right direction. To be specific, the pair of intermediate members 24 and 25 serve as left-right movement stopper receivers configured to prevent the car body 2 from being excessively displaced relative to the bogie 1 in the left-right direction (car width direction).

In the present embodiment, the center pin accommodating member 26 includes the tubular portion 26*a*, the longitudinal attaching portions 26*b*, and the lateral attaching portions 26*c*. However, the present embodiment is not limited to this. For example, the lateral attaching portions 26*c* may be omitted, and the intermediate members 24 and 25 may be directly joined to the tubular portion 26*a*. Various modified examples are applicable.

Each of the air spring seats 27 is provided on upper surfaces of the pair of pipe members 22 and 23 and an upper surface of the intermediate member 24 or 25 so as to be located at the car width direction end portion 5*a* of the cross beam 5. Each of the air spring seats 27 has a plate shape. Each of the pressing members 18 is provided on lower surfaces of the pair of pipe members 22 and 23 and a lower surface of the intermediate member 24 or 25 so as to be located at the car width direction end portion 5*a* of the cross beam 5. The pair of pipe members 22 and 23 and the intermediate members 24 and 25 are fixed to each other through the air spring seats 27 and the pressing members 18. Each of the pressing members 18 includes a pressing portion 18*a* and plate-shaped attaching portions 18*b*. The pressing portion 18*a* includes a lower surface having a circular-arc shape when viewed from the car width direction. The attaching portions 18*b* are provided at both sides of the pressing portion 18*a* in the car width direction. In the present embodiment, the air spring seats 27 are provided at the car width direction end portions 5*a* of the cross beam 5. However, the present embodiment is not limited to this, and the air spring seats 27 may be provided at desired positions in the car width direction depending on the type of a car.

Each of the pressing members 18 is fixed to the pipe members 22 and 23 and the intermediate member 24 or 25 by the attaching portions 18*b*. With this, the pressing members 18 configured to transmit the downward load from the cross beam 5 to the plate springs 13 serve to connect the pipe members 22 and 23 and the intermediate members 24 and 25 with each other. Moreover, since the pressing members 18 are integrated with the cross beam 5, the number of parts is made smaller than when, for example, the pressing members 18 configured as separate parts are engaged with the cross beam 5. Therefore, the structure of the bogie and the assembly work are simplified.

Figure 9:
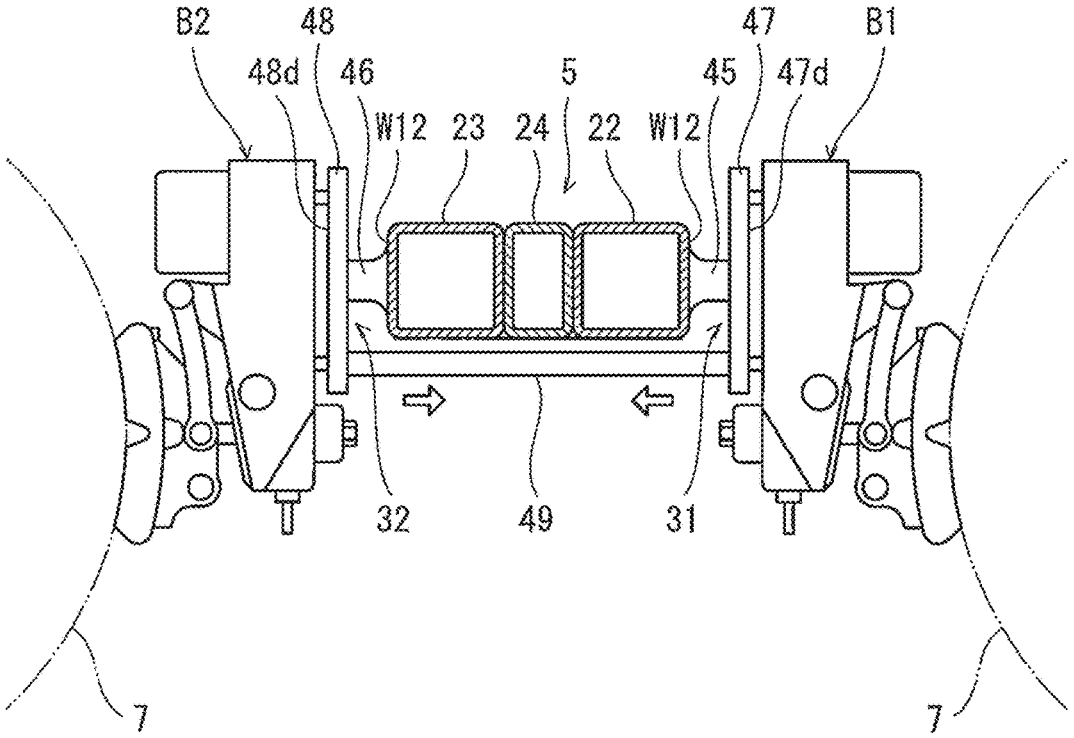
FIG. 9 is a side view for explaining the brake receiving seats and coupling member of FIG. 8.

At each of the car width direction end portions 5*a* of the cross beam 5, a first brake receiving seat 31 is joined to the linear portion 22*a* of the pipe member 22, and a second brake receiving seat 32 is joined to the linear portion 23*a* of the pipe member 23. As shown in FIG. 9, a unit-type first wheel tread brake device or brake B1 configured to brake the wheel 7 located at one side in the car longitudinal direction is fixed to the first brake receiving seat 31, and a unit-type second wheel tread brake device or brake B2 is fixed to the second brake receiving seat 32. The first wheel tread brake device B1 and the second wheel tread brake device B2 are independent from each other and individually brake a pair of wheels 7 arranged away from each other in the car longitudinal direction. The wheel tread brake devices B1 and B2 are arranged so as to project downward beyond the cross beam 5.

The car width direction end portion 5*a* of the cross beam 5 is smaller in size in the car longitudinal direction than the car width direction middle portion 5*b* of the cross beam 5. Therefore, work spaces are secured such that the wheel tread brake devices B1 and B2 can be arranged easily. The curved portions 22*b* and 23*b* are formed at the pair of pipe members 22 and 23 so as to be located at the car width direction middle portion 5*b* of the cross beam 5. Therefore, a clearance between the pair of pipe members at the car width direction middle portion 5*b* of the cross beam 5 is wide, but a clearance between the pair of pipe members at each of the car width direction end portions of the cross beam is narrow. On this account, by a simple step that is bending of the pipe members 22 and 23, the arrangement spaces for the wheel tread brake devices B1 and B2 can be easily secured, and in addition, productivity improves.

A first gear box G1 and a first traction motor M1 are arranged at one side of the cross beam 5 in the car longitudinal direction, and a second gear box G2 and a second traction motor M2 are arranged at the other side of the cross beam 5 in the car longitudinal direction. The traction motor M1 is connected to the gear box G1 through a universal joint 33, and the traction motor M2 is connected to the gear box G2 through a universal joint 34. The first and second gear boxes G1 and G2 are connected to the corresponding axles 6. To be specific, in a plan view, the first gear box G1 and the second gear box G2 are arranged symmetrically about a point that is a center of the cross beam 5, and the first traction motor M1 and the second traction motor M2 are arranged symmetrically about the point that is the center of the cross beam 5.

A first gear box receiving seat 35 and a second gear box receiving seat 36 are joined to the cross beam 5 by circumferential welding. The first gear box G1 is fixed to the first gear box receiving seat 35, and the second gear box G2 is fixed to the second gear box receiving seat 36. The first gear box receiving seat 35 is arranged between a top of the curved portion 22*b* and the first brake receiving seat 31 in the car width direction, and the second gear box receiving seat 36 is arranged between a top of the curved portion 23*b* and the second brake receiving seat 32 in the car width direction. A vertical size of a joining end of the gear box receiving seat 35 which end is opposed to the curved portion 22*b* is smaller than a vertical size of an outer surface of the curved portion 22*b* which surface is located outside in the car longitudinal direction, and a vertical size of a joining end of the gear box receiving seat 36 which end is opposed to the curved portion 23*b* is smaller than a vertical size of an outer surface of the curved portion 23*b* which surface is located outside in the car longitudinal direction. A welded portion W2 by which the joining end of the gear box receiving seat 35 and the curved portion 22*b* are joined to each other is provided at and accommodated in the outer surface of the curved portion 22*b*. Another welded portion W2 by which the joining end of the gear box receiving seat 36 and the curved portion 23*b* are joined to each other is provided at and accommodated in the outer surface of the curved portion 23*b*.

The gear box receiving seat 35 is joined to the outer surface of the curved portion 22*b* which surface is inclined relative to the car width direction, and the gear box receiving seat 36 is joined to the outer surface of the curved portion 23*b* which surface is inclined relative to the car width direction. Therefore, the gear box receiving seat 35 projects diagonally from the curved portion 22*b* outward in the car longitudinal direction and outward in the car width direction, and the gear box receiving seat 36 projects diagonally from the curved portion 23*b* outward in the car longitudinal direction and outward in the car width direction. According to this configuration, even when the wheel tread brake device B1 is arranged close to the gear box G1 in the car width direction, and the wheel tread brake device B2 is arranged close to the gear box G2 in the car width direction, a portion of the pipe member 22 to which portion the gear box receiving seat 35 is joined is located away from the brake receiving seat 31 in the car width direction, and a portion of the pipe member 23 to which portion the gear box receiving seat 36 is joined is located away from the brake receiving seat 32 in the car width direction. Therefore, work of welding the gear box receiving seat 35 to the pipe member 22 and welding the gear box receiving seat 36 to the pipe member 23 is facilitated.

A first traction motor receiving seat 37 and a second traction motor receiving seat 38 are joined to the cross beam 5 by circumferential welding. The first traction motor M1 is fixed to the first traction motor receiving seat 37, and the second traction motor M2 is fixed to the second traction motor receiving seat 38. The first traction motor receiving seat 37 is arranged at an opposite side of the first gear box receiving seat 35 in the car width direction so as to be located between the top of the curved portion 22*b* and the first brake receiving seat 31. The second traction motor receiving seat 38 is arranged at an opposite side of the second gear box receiving seat 36 in the car width direction so as to be located between the top of the curved portion 23*b* and the second brake receiving seat 32. A vertical size of a joining end of the traction motor receiving seat 37 which end is opposed to the curved portion 22*b* is smaller than a vertical size of an outer surface of the curved portion 22*b* which surface is located outside in the car longitudinal direction, and a vertical size of a joining end of the traction motor receiving seat 38 which end is opposed to the curved portion 23*b* is smaller than a vertical size of an outer surface of the curved portion 23*b* which surface is located outside in the car longitudinal direction. A welded portion W3 by which the joining end of the traction motor receiving seat 37 and the curved portion 22*b* are joined to each other is provided at and within the outer surface of the curved portion 22*b*. Another welded portion W3 by which the joining end of the traction motor receiving seat 38 and the curved portion 23*b* are joined to each other is provided at and within the outer surface of the curved portion 23*b*.

The above-described receiving sills 14 are fixed to lower surfaces of the car width direction end portions 5*a* of the cross beam 5. Each of the receiving sills 14 extends from the car width direction end portion 5*a* of the cross beam 5 toward both sides in the car longitudinal direction. The receiving sill 14 includes a pair of side wall portions 14*a* arranged away from each other in the car width direction, and the pressing member 18 is arranged in a space between the pair of side wall portions 14*a*.

Figure 5:
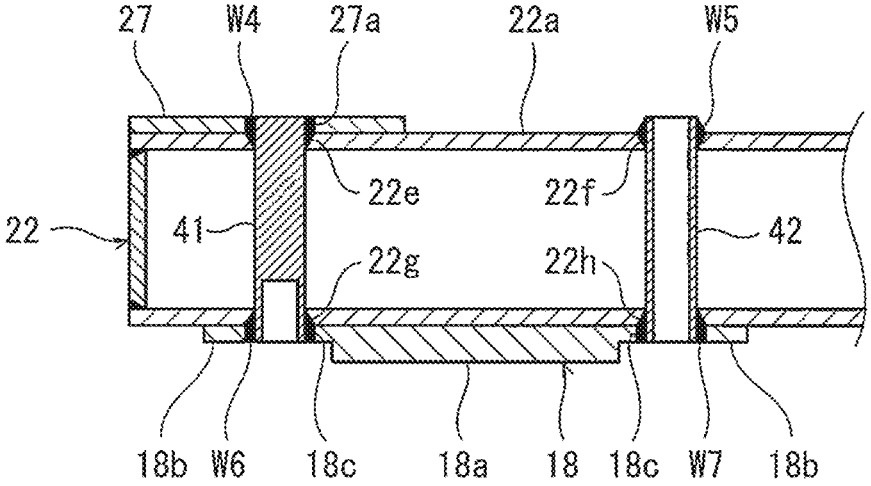
FIG. 5 is a longitudinal sectional view of a pipe member of the bogie frame of FIG. 3 when viewed from a car longitudinal direction.

FIG. 5 is a longitudinal sectional view of the pipe member 22 of the bogie frame 4 of FIG. 3 when viewed from the car longitudinal direction. It should be noted that FIG. 5 representatively shows the pipe member 22 that is one of the pair of pipe members 22 and 23. The pipe member 23 is the same in structure as the pipe member 22. As shown in FIGS. 3 to 5, first projecting members or structures 41 and second projecting members or structures 42 are provided at the pipe member 22. The first projecting members 41 and the second projecting members 42 project upward and downward from the linear portions 22*a* located at the car width direction end portions of the pipe member 22. Specifically, a fitting hole 22*e* and a fitting hole 22*f* are formed at an upper wall portion of each linear portion 22*a* of the pipe member 22 so as to be spaced apart from each other in the car width direction. The fitting holes 22*e* and 22*f* penetrate the upper wall portion of the linear portion 22*a* of the pipe member 22 in the vertical direction. An upper end portion of the first projecting member 41 is fitted in the fitting hole 22*e*, and an upper end portion of the second projecting member 42 is fitted in the fitting hole 22*f*. In the present embodiment, each of outer peripheral surfaces of the first projecting members 41 and the second projecting members 42 has a circular shape from the viewpoint of below-described weldability but may have a polygonal shape. The first projecting members 41 and the second projecting members 42 may be hollow or solid. The first projecting members 41 and the second projecting members 42 do not have to penetrate the pipe members 22 and 23 and may be fixed to the surfaces of the pipe members 22 and 23.

An attaching hole 27*a* is formed at the air spring seat 27. A diameter of the attaching hole 27*a* is larger than an outer diameter of a portion of the first projecting member 41 which portion projects from the pipe member 22. When viewed from above, the attaching hole 27*a* includes the fitting hole 22*e*. The upper end portion of the first projecting member 41 is inserted into the attaching hole 27*a* with some play. The upper end portion of the first projecting member 41 is joined to the pipe member 22 by circumferential welding through the attaching hole 27*a* of the air spring seat 27 and also joined to the air spring seat 27 by circumferential welding. The upper end portion of the second projecting member 42 is also joined to the pipe member 22 by circumferential welding. As above, the air spring seats 27 are fixed to the pipe members 22 and 23 through the first projecting members 41, and therefore, the pair of pipe members 22 and 23 are connected to each other. A welded portion W4 by which the first projecting member 41 and the air spring seat 27 are joined to each other is formed in a closed loop shape along the outer peripheral surface of the first projecting member 41. A welded portion W5 by which the second projecting member 42 and the pipe member 22 are joined to each other is also formed in a closed loop shape along the outer peripheral surface of the second projecting member 42. Each welded portion is formed throughout the projecting member according to need, and with this, desired strength as the bogie frame is secured. According to this, since each of the welded portions W4 and W5 is formed in a closed loop shape having no end edge, robot welding is easily performed, and therefore, productivity improves.

A fitting hole 22*g* and a fitting hole 22*h* are formed at a lower wall portion of each linear portion 22*a* of the pipe member 22 so as to be spaced apart from each other in the car width direction. The fitting holes 22*g* and 22*h* penetrate the lower wall portion of the linear portion 22*a* of the pipe member 22 in the vertical direction. A lower end portion of the first projecting member 41 is fitted in the fitting hole 22*g*, and a lower end portion of the second projecting member 42 is fitted in the fitting hole 22*h*. Attaching holes 18*c* are formed at the attaching portions 18*b* of the pressing member 18. Diameters of the attaching holes 18*c* are larger than outer diameters of portions of the first and second projecting members 41 and 42 which portions project from the pipe member 22. When viewed from below, the attaching holes 18*c* include the corresponding fitting holes 22*g* and 22*h*. The lower end portions of the first and second projecting members 41 and 42 are inserted into the corresponding attaching holes 18*c* with some play.

The lower end portions of the first and second projecting members 41 and 42 are joined to the pipe member 22 by circumferential welding through the attaching holes 18*c* of the attaching portions 18*b* of the pressing member 18 and also joined to the attaching portions 18*b* of the pressing member 18 by circumferential welding. As above, the pressing members 18 are fixed to the pipe members 22 and 23 through the first projecting members 41 and the second projecting members 42, and with this, the pair of pipe members 22 and 23 are connected to each other. A welded portion W6 by which the pressing member 18 is joined to the first projecting member 41 is formed in a closed loop shape along the outer peripheral surface of the first projecting member 41, and a welded portion W7 by which the pressing member 18 is joined to the second projecting member 42 is formed in a closed loop shape along the outer peripheral surface of the second projecting member 42.

Figure 6:
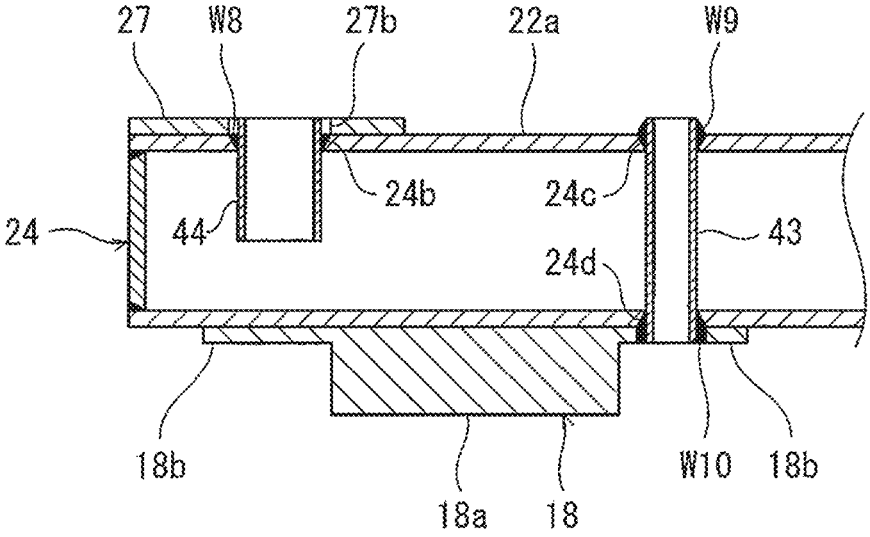
FIG. 6 is a longitudinal sectional view of an intermediate member of the bogie frame of FIG. 3 when viewed from the car longitudinal direction.

FIG. 6 is a longitudinal sectional view of the intermediate member 24 of the bogie frame 4 of FIG. 3 when viewed from the car longitudinal direction. It should be noted that FIG. 6 representatively shows the intermediate member 24 that is one of the pair of intermediate members 24 and 25. The intermediate member 25 is the same in structure as the intermediate member 24. As shown in FIGS. 3, 4, and 6, a third projecting member or structure 43 is provided at the intermediate member 24. The third projecting member 43 projects upward and downward from the intermediate member 24 at a position which overlaps the pressing member 18 in a plan view. Moreover, a tubular body 44 is provided at the intermediate member 24 so as to be located at a position which overlaps the air spring seat 27. The tubular body 44 makes the internal space of the intermediate member 24 communicate with the air spring 3.

Specifically, fitting holes 24*b* and 24*c* are formed at an upper wall portion of the intermediate member 24 so as to be spaced apart from each other in the car width direction. The fitting holes 24*b* and 24*c* penetrate the upper wall portion of the intermediate member 24 in the vertical direction. An upper end portion of the third projecting member 43 is fitted in the fitting hole 24*c*, and an upper end portion of the tubular body 44 is fitted in the fitting hole 24*b*. A fitting hole 24*d* in which the third projecting member 43 is fitted is formed at a lower wall portion of the intermediate member 24. In the present embodiment, each of an outer peripheral surface of the third projecting member 43 and an outer peripheral surface of the tubular body 44 has a circular shape but may have a polygonal shape. The tubular body 44 is preferred to be hollow and be configured such that an internal space thereof is open upward and downward, although other configurations are possible. However, the third projecting member 43 may be hollow or solid. The third projecting member 43 does not have to penetrate the intermediate member 24 (25) and may be fixed to a surface of the intermediate member 24 (25). In the present embodiment, the number of projecting members 41 to 44 is one example and may be suitably increased or decreased according to need.

An insertion hole 27*b* is formed at the air spring seat 27. A diameter of the insertion hole 27*b* is larger than an outer diameter of a portion of the tubular body 44 which portion projects upward from the intermediate member 24. When viewed from above, the insertion hole 27*b* includes the fitting hole 24*b*. The upper end portion of the tubular body 44 is inserted into the insertion hole 27*b* with some play. The upper end portion of the tubular body 44 is joined to the intermediate member 24 by circumferential welding through the insertion hole 27*b* of the air spring seat 27. A welded portion W8 by which the tubular body 44 and the intermediate member 24 are joined to each other does not have to be joined to the air spring seat 27. Welded portions W9 and W10 by which the third projecting member 43 and the intermediate member 24 are joined to each other are the same as the welded portions W5 and W7 by which the second projecting member 42 and the pipe member 22 are joined to each other.

Figure 7:
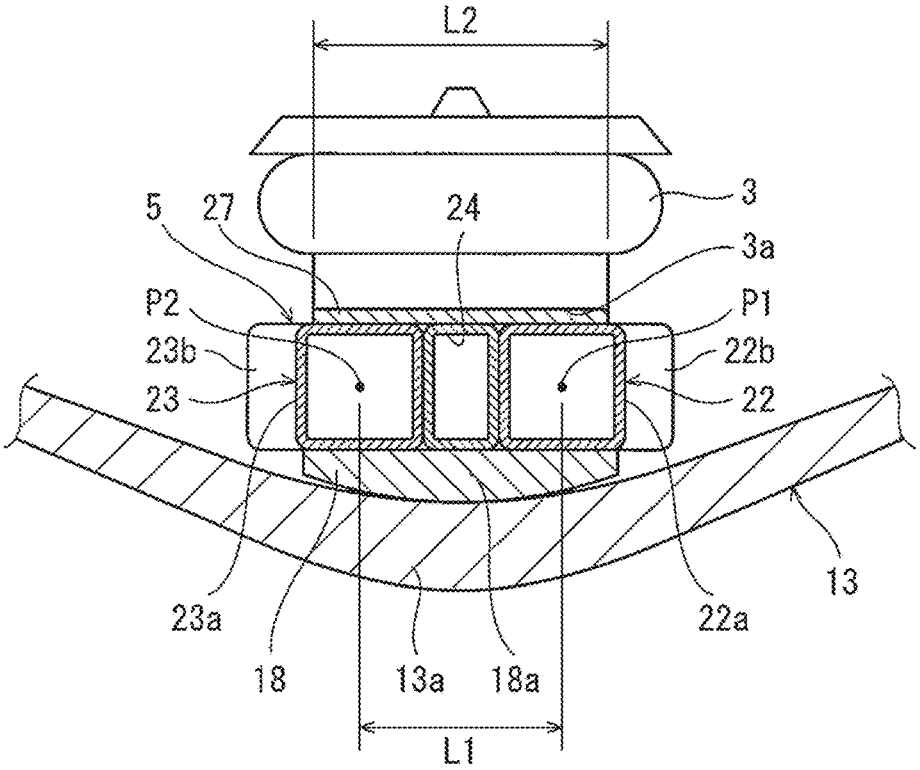
FIG. 7 is a longitudinal sectional view of an air spring seat and pressing member of the bogie of FIG. 1 when viewed from a car width direction.

FIG. 7 is a longitudinal sectional view of the air spring seat 27 and pressing member 18 of the bogie 1 of FIG. 1 when viewed from the car width direction. As shown in FIG. 7, the clearance between the pipe members 22 and 23 is adequately shorter than a size of a lower end surface 3*a* of the air spring 3 in the car longitudinal direction. To be specific, at a position that is the same in the car width direction as the position of the air spring 3, a distance L 1 between a center P1 of the linear portion 22*a* of the pipe member 22 and a center P2 of the linear portion 23*a* of the pipe member 23 in the car longitudinal direction is shorter than the car longitudinal direction size of the lower end surface 3*a* of the air spring 3 mounted on the air spring seat 27. The lower end surface 3*a* of the air spring 3 overlaps the pipe members 22 and 23 so as to include the car longitudinal direction centers P1 and P2 of the car width direction end portions of the pipe members 22 and 23 when viewed from above. Similarly, the air spring seat 27 overlaps the pipe members 22 and 23 so as to include the centers P1 and P2 of the car width direction end portions of the pipe members 22 and 23 when viewed from above. A load transmitted from the air spring 3 through the air spring seat 27 to the cross beam 5 is transmitted to the middle portion 13*a* of the plate spring 13 by the pressing member 18.

The curved portions 22*b* and 23*b* are formed at the pair of pipe members 22 and 23 so as to be located at the car width direction middle portion 5*b* of the cross beam 5. Therefore, the clearance between the pair of pipe members 22 and 23 at the car width direction middle portion 5*b* of the cross beam 5 is wide, but the clearance between the pair of pipe members 22 and 23 at each of the car width direction end portions 5*a* of the cross beam 5 is narrow. On this account, even when the center pin arrangement space S is formed between the pair of pipe members 22 and 23 at the car width direction middle portion 5*b* of the cross beam 5, the pipe members 22 and 23 are prevented from largely protruding from the lower end surface 3*a* of the air spring 3 outward in the car longitudinal direction. Thus, smooth load transmission from the air springs 3 to the pipe members 22 and 23 is realized while adequately securing the center pin arrangement space S. As above, the downward loads from the air springs 3 are smoothly transmitted to the centers P1 and P2 of the car width direction end portions of the pipe members 22 and 23. Therefore, stress generated at the air spring seats 27 themselves and stress generated at joined portions between the air spring seat 27 and the pipe members 22 and 23 are effectively reduced.

Figure 8:
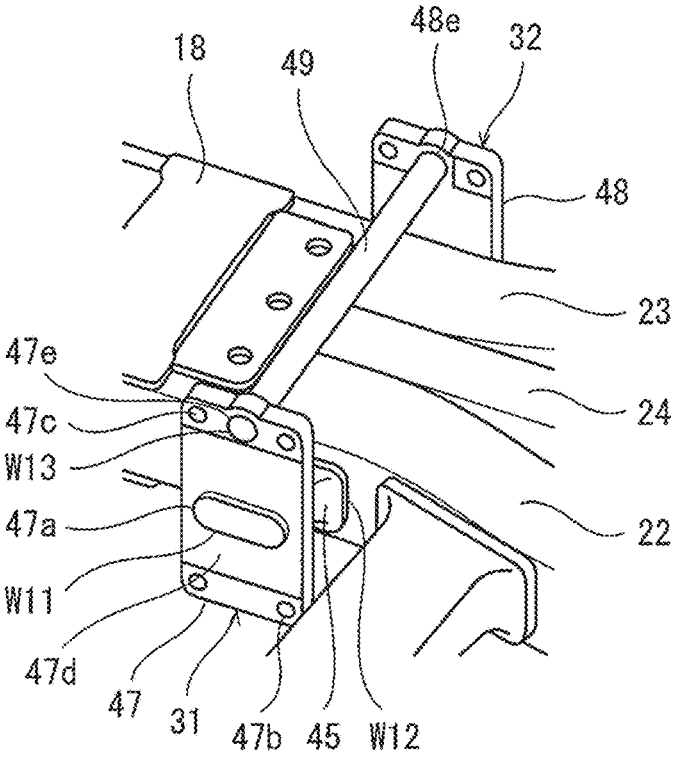
FIG. 8 is a perspective view for explaining brake receiving seats and a coupling member of FIG. 4 when viewed from below.

FIG. 8 is a perspective view for explaining the brake receiving seats 31 and 32 and a coupling member or structure 49 of FIG. 4 when viewed from below. FIG. 9 is a side view for explaining the brake receiving seats 31 and 32 and coupling member 49 of FIG. 8. As shown in FIGS. 8 and 9, the first brake receiving seat 31 includes an attaching portion 45 and a receiving seat portion 47. The attaching portion 45 projects from the cross beam 5 outward in the car longitudinal direction, and the receiving seat portion 47 extends from the attaching portion 45 in the vertical direction. Moreover, the second brake receiving seat 32 includes an attaching portion 46 and a receiving seat portion 48. The attaching portion 46 projects from the cross beam 5 outward in the car longitudinal direction, and the receiving seat portion 48 extends from the attaching portion 46 in the vertical direction. The attaching portion 45 of the first brake receiving seat 31 is joined to an outer surface of the pipe member 22 which surface is located outside in the car longitudinal direction. The first wheel tread brake device B1 is fixed to the receiving seat portion 47 of the first brake receiving seat 31. The attaching portion 46 of the second brake receiving seat 32 is joined to an outer surface of the pipe member 23 which surface is located outside in the car longitudinal direction. The second wheel tread brake device B2 is fixed to the receiving seat portion 48 of the second brake receiving seat 32.

Through holes 47*a* are formed at the receiving seat portions 47 and 48. The attaching portion 45 is inserted into the through hole 47*a* of the receiving seat portion 47 and joined to the receiving seat portion 47 by circumferential welding, and the attaching portion 46 is inserted into the through hole 47*a* of the receiving seat portion 48 and joined to the receiving seat portion 48 by circumferential welding. To be specific, a welded portion W11 by which the receiving seat portion 47 and the attaching portion 45 inserted into the through hole 47*a* of the receiving seat portion 47 are joined to each other is formed in a closed loop shape along a peripheral edge of the through hole 47*a*, and another welded portion W11 by which the receiving seat portion 48 and the attaching portion 46 inserted into the through hole 47*a* of the receiving seat portion 48 are joined to each other is formed in a closed loop shape along a peripheral edge of the through hole 47*a*. As above, since each of the welded portions W11 is formed in a closed loop shape having no end edge, the robot welding is easily performed, and therefore, the productivity improves.

A vertical size of a joining end of the attaching portion 45 which end is located close to the pipe member 22 is smaller than a vertical size of the outer surface of the pipe member 22 which surface is located outside in the car longitudinal direction. A vertical size of a joining end of the attaching portion 46 which end is located close to the pipe member 23 is smaller than a vertical size of the outer surface of the pipe member 23 which surface is located outside in the car longitudinal direction. A welded portion W12 by which the joining end of the attaching portion 45 and the pipe member 22 are joined to each other is provided at and within the outer surface of the pipe member 22. Another welded portion W12 by which the joining end of the attaching portion 46 and the pipe member 23 are joined to each other is provided at and within the outer surface of the pipe member 23. With this, since stress generated when a car body load is applied to the air spring seats 27 mainly concentrates on the upper surface and lower surface of the cross beam 5, stress generated at the welded portions W12 provided at not the upper and lower surfaces of the cross beam 5 but the side surfaces of the cross beam 5 is small. Fastening holes 47*b* and 47*c* to which the wheel tread brake device B1 is fastened are formed at upper and lower portions of the receiving seat portion 47, and fastening holes 47*b* and 47*c* to which the wheel tread brake device B2 is fastened are formed at upper and lower portions of the receiving seat portion 48.

The coupling member 49 is arranged under the cross beam 5. The coupling member 49 is sandwiched between the receiving seat portion 47 of the first brake receiving seat 31 and the receiving seat portion 48 of the second brake receiving seat 32. The coupling member 49 couples the lower portion of the receiving seat portion 47 of the first brake receiving seat 31 and the lower portion of the receiving seat portion 48 of the second brake receiving seat 32. The coupling member 49 is located at substantially a height of the center of the axle and extends in a direction perpendicular to brake supporting surfaces 47*d* and 48*d* of the receiving seat portions 47 and 48. For example, the coupling member 49 has a rod shape. The number of coupling members 49 is one in the present embodiment but may be plural.

An insertion hole 47*e* is formed at the lower portion of the receiving seat portion 47 of the brake receiving seat 31, and an insertion hole 48*e* is formed at the lower portion of the receiving seat portion 48 of the brake receiving seat 32. Car longitudinal direction end portions of the coupling member 49 are inserted into the insertion holes 47*e* and 48*e* and joined to the receiving seat portions 47 and 48 by circumferential welding. To be specific, a welded portion W13 by which the end portion of the coupling member 49 inserted into the insertion hole 47*e* and the receiving seat portion 47 are joined to each other is formed in a closed loop shape along a peripheral edge of the insertion hole 47*e*. Another welded portion W13 by which the end portion of the coupling member 49 inserted into the insertion hole 48*e* and the receiving seat portion 48 are joined to each other is formed in a closed loop shape along a peripheral edge of the insertion hole 48*e*. According to this, since the coupling member 49 is positioned with respect to the receiving seat portions 47 and 48 by being inserted into the insertion holes 47*e* and 48*e*, work of welding the coupling member 49 to the receiving seat portions 47 and 48 can be easily performed.

As shown in FIG. 9, brake reaction force applied from the wheel 7 to the wheel tread brake device B1 during braking is transmitted to the receiving seat portion 47 of the brake receiving seat 31, and brake reaction force applied from the wheel 7 to the wheel tread brake device B2 during braking is transmitted to the receiving seat portion 48 of the brake receiving seat 32. The coupling member 49 serves as a tension rod that acts against the brake reaction force. Therefore, the brake reaction force applied to the first brake receiving seat 31 and the brake reaction force applied to the second brake receiving seat 32 are canceled out through the coupling member 49, and therefore, a preference of providing strong reinforcing members at the brake receiving seats 31 and 32 can be eliminated.

Figure 10:
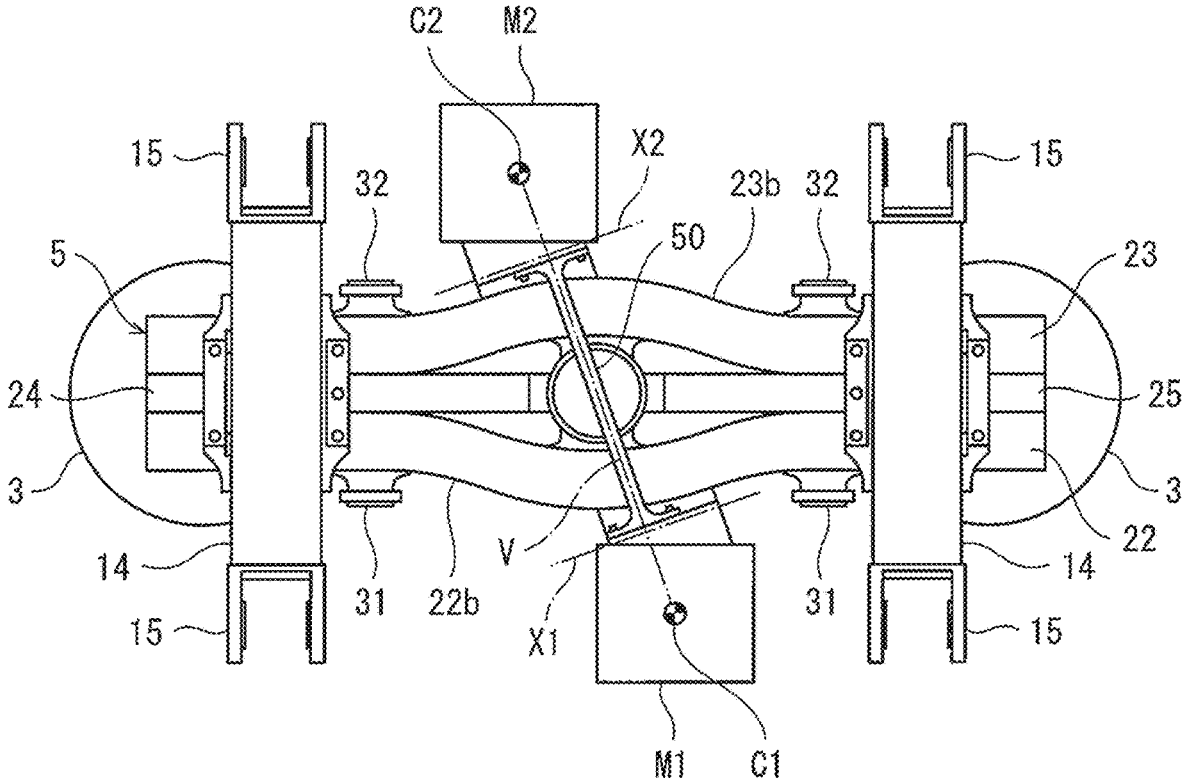
FIG. 10 is a bottom view for explaining traction motors and a coupling member in the bogie shown in FIG. 2.
Figure 11:
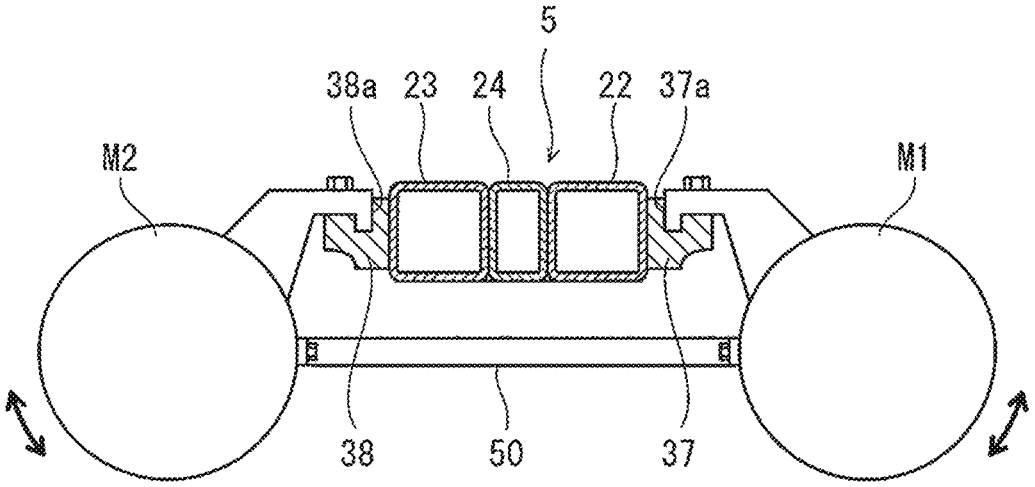
FIG. 11 is a side view for explaining the traction motors and the coupling member shown in FIG. 10.

FIG. 10 is a bottom view for explaining the traction motors M1 and M2 and a coupling member or structure 50 in the bogie shown in FIG. 2. FIG. 11 is a side view for explaining the traction motors M1 and M2 and the coupling member 50 shown in FIG. 10. As shown in FIGS. 10 and 11, the coupling member 50 is arranged under the cross beam 5. The coupling member 50 is sandwiched between the first traction motor M1 and the second traction motor M2. The coupling member 50 couples the first traction motor M1 and the second traction motor M2 to each other. The coupling member 50 has, for example, a substantially I shape, and both end portions of the coupling member 50 are fixed to the traction motors M1 and M2. The number of coupling members 50 is one but may be plural.

The traction motor receiving seat 37 includes a keyway 37*a* to which the traction motor M1 is locked and which extends along the cross beam 5. The traction motor receiving seat 38 includes a keyway 38*a* to which the traction motor M2 is locked and which extends along the cross beam 5. The traction motor M1 is fastened to the traction motor receiving seat 37 while being locked to the keyway 37*a*, and the traction motor M2 is fastened to the traction motor receiving seat 38 while being locked to the keyway 38*a*. The traction motor receiving seat 37 is joined to an outer surface of the curved portion 22*b* which surface is inclined relative to the car width direction, and the traction motor receiving seat 38 is joined to an outer surface of the curved portion 23*b* which surface is inclined relative to the car width direction. Therefore, the keyways 37*a* and 38*a* are inclined relative to the car width direction. The first traction motor M1 is attached to the first traction motor receiving seat 37 so as to swing about the keyway 37*a* serving as a first swing axis X1, and the second traction motor M2 is attached to the second traction motor receiving seat 38 so as to swing about the keyway 38*a* serving as a second swing axis X2. The traction motor receiving seats 37 and 38 are desired to be arranged such that the swing axes X1 and X2 are perpendicular to a virtual line V. The keyways 37*a* and 38*a* do not necessarily have to be inclined relative to the car width direction.

In a plan view, each of the swing axis X1 of the first traction motor M1 and the swing axis X2 of the second traction motor M2 is inclined relative to the car width direction in such a direction that a bogie middle side of the swing axis X1, X2 extends away from the center of the cross beam 5. In a plan view, the swing axis X1 of the first traction motor M1 and the swing axis X2 of the second traction motor M2 are substantially perpendicular to a virtual line V connecting a gravity center C1 of the first traction motor M1 and a gravity center C2 of the second traction motor M2. The coupling member 50 extends along the virtual line V. When the number of coupling members 50 is one, the coupling member 50 is desired to overlap the virtual line V in a plan view.

With this, when the traction motors M1 and M2 are about to swing in the upper-lower direction, the coupling member 50 serves as a tension rod that acts against the swinging, and therefore, the swinging of the first traction motor M1 and the swinging of the second traction motor M2 are canceled out through the coupling member 50. On this account, the requirement of the strength of a support structure for the traction motors M1 and M2 can be lowered by a simple configuration. Since the swing axes X1 and X2 of the traction motors M1 and M2 are substantially perpendicular to the virtual line V in a plan view, a load generated by the swinging of the traction motor M1 and a load generated by the swinging of the traction motor M2 are opposed to each other, and therefore, the generation of torsional force at the coupling member 50 is suppressed. Then, since the coupling member 50 extends along the virtual line V, the strength of the coupling member 50 in a pulling direction and a compressing direction is desired to be secured. Therefore, the swinging of the traction motor M1 and the swinging of the traction motor M2 can be effectively canceled out while reducing the weight of the coupling member 50.

According to the present invention, in the bogie frame including the cross beam having the pair of pipe members which extend in the car width direction and are lined up in the car longitudinal direction, smooth load transmission from the air springs to the pair of pipe members can be realized while securing the arrangement space for the center pin.

The present invention is not limited to the above embodiment, and modifications, additions, and eliminations may be made with respect to the configuration of the embodiment. For example, the above embodiment has described the bogie which omits the side sills of the bogie frame and includes the plate springs. However, the above embodiment may adopt a general bogie including side sills extending from both car width direction end portions of a cross beam in a car longitudinal direction. The general bogie is preferably configured such that the car width direction end portions 5*a* of the cross beam 5 are fixed to the side sills by welding or the like. Moreover, the general bogie does not require the pressing members 18 that press the plate springs 13. Therefore, instead of the pressing members 18, plate-shaped members are simply used for mutual connections among the lower surfaces of the pipe members 22 and 23 and the lower surfaces of the intermediate members 24 and 25, and as with the air spring seat 27, the pipe members 22 and 23 and the intermediate members 24 and 25 are preferably fixed to each other through the projecting members. The curved portion (22*b*) may be formed at only one of the pair of pipe members 22 and 23. The center pin may be connected to a single link type traction device through the center pin arrangement space S without providing the center pin accommodating member 26. The above embodiment has described a driving bogie but may adopt a non-driving bogie. The non-driving bogie does not require structures related to the traction motor and the gear box, but the structures of the cross beam 5 and the brake receiving seat may be suitably adopted in the non-driving bogie.

REFERENCE SIGNS LIST

1 bogie
3 air spring
3*a* lower end surface
4 bogie frame
5 cross beam
5*a* car width direction end portion
5*b* car width direction middle portion
13 plate spring
13*a* car width direction middle portion
13*b* car width direction end portion
18 pressing member or structure
22 pipe member or pipe
22*a* linear portion
22*b* curved portion
24, 25 intermediate member or structure
26 center pin accommodating member or structure
26*a* tubular portion
26*b* longitudinal attaching portion
26*c* lateral attaching portion
27 air spring seat
30 center pin
31 first brake receiving seat
32 second brake receiving seat
35 first gear box receiving seat
36 second gear box receiving seat
37 first traction motor receiving seat
37*a* keyway
38 second traction motor receiving seat
38*a* keyway
41 first projecting member or structure
42 second projecting member or structure
43 third projecting member or structure
45, 46 attaching portion
47, 48 receiving seat portion
49 coupling member or structure
50 coupling member or structure
B1 first wheel tread brake device or brake
B2 second wheel tread brake device or brake
C1, C2 gravity center
G1 first gear box
G2 second gear box
M1 first traction motor
M2 second traction motor
P1, P2 center
S center pin arrangement space
V virtual line
W1 to W13 welded portion
X1 first swing axis
X2 second swing axis

The invention claimed is:

1. A railcar bogie frame, comprising a cross beam extending in a car width direction and including a car width direction middle portion at which there is a center pin arrangement space, wherein:

the cross beam includes a pair of elongated supports extending in the car width direction and located away from each other in a car longitudinal direction and air spring seats at upper surfaces of car width direction end portions of the pair of elongated supports;

at least one of the pair of elongated supports includes a curved portion at a car width direction middle portion thereof, the curved portion projecting outward in the car longitudinal direction such that a clearance between the pair of elongated supports increases;

the center pin arrangement space is between the pair of elongated supports by the curved portion;

the cross beam further includes projections which project from the pair of elongated supports in a vertical direction;

the air spring seats include attaching holes into which the projections are inserted; and each of welded portions by which outer peripheral surfaces of the projections inserted into the attaching holes and the air spring seats are joined to each other has a closed loop shape along the outer peripheral surface of the projections.

2. The railcar bogie frame according to claim 1, wherein distances each between centers of the car width direction end portions of the pair of elongated supports in the car longitudinal direction are shorter than respective sizes of lower end surfaces of air springs in the car longitudinal direction, the air springs being placed on the respective air spring seats.

3. The railcar bogie frame according to claim 1, further comprising:

a gear box receiving seat at the cross beam and supporting a gear box; and a brake receiving seat at the cross beam so as to be located outside the gear box receiving seat in the car width direction, the brake receiving seat supporting a brake, wherein:

the gear box receiving seat projects diagonally from the curved portion outward in the car longitudinal direction and outward in the car width direction; and a welded portion joining the gear box receiving seat and an outer surface of the curved portion between the gear box receiving seat and the outer surface of the curved portion.

4. The railcar bogie frame according to claim 1, wherein the elongated supports are pipes.

5. The railcar bogie frame according to claim 1, further comprising:

a pressing structure on lower surfaces of the pair of elongated supports to press a longitudinal direction middle portions of plate springs from above, the plate springs supporting car width direction end portions of the cross beam, the pressing structure being fixed to the pair of elongated supports.

6. A railcar bogie frame, comprising a cross beam extending in a car width direction and including a car width direction middle portion at which there is a center pin arrangement space, wherein:

the cross beam includes a pair of elongated supports extending in the car width direction and located away from each other in a car longitudinal direction and air spring seats at upper surfaces of car width direction end portions of the pair of elongated supports;

at least one of the pair of elongated supports includes a curved portion at a car width direction middle portion thereof, the curved portion projecting outward in the car longitudinal direction such that a clearance between the pair of elongated supports increases;

the center pin arrangement space is between the pair of elongated supports by the curved portion;

wherein the cross beam further includes:

a pair of intermediate structures at both sides of the center pin arrangement space in the car width direction and extending in the car width direction, each of the pair of intermediate structures being connected to the pair of elongated supports while being sandwiched between the car width direction end portions.

7. The railcar bogie frame according to claim 6, wherein:

the cross beam further includes a center pin accommodating structure between the pair of elongated supports and forming the center pin arrangement space; and the center pin accommodating structure includes lateral attaching portions joined to end edges of the intermediate structures, the end edges being opposed to the center pin accommodating structure.

8. The railcar bogie frame according to claim 6, further comprising:

a gear box receiving seat at the cross beam and supporting a gear box; and a brake receiving seat at the cross beam so as to be located outside the gear box receiving seat in the car width direction, the brake receiving seat supporting a brake, wherein:

the gear box receiving seat projects diagonally from the curved portion outward in the car longitudinal direction and outward in the car width direction; and a welded portion joining the gear box receiving seat and an outer surface of the curved portion between the gear box receiving seat and the outer surface of the curved portion.

9. The railcar bogie frame according to claim 6, wherein the elongated supports are pipes.

10. The railcar bogie frame according to claim 6, further comprising:

a pressing structure on lower surfaces of the pair of elongated supports to press a longitudinal direction middle portions of plate springs from above, the plate springs supporting car width direction end portions of the cross beam, the pressing structure being fixed to the pair of elongated supports.

11. A railcar bogie frame, comprising a cross beam extending in a car width direction and including a car width direction middle portion at which there is a center pin arrangement space, wherein:

the cross beam includes a pair of elongated supports extending in the car width direction and located away from each other in a car longitudinal direction and air spring seats at upper surfaces of car width direction end portions of the pair of elongated supports;

at least one of the pair of elongated supports includes a curved portion at a car width direction middle portion thereof, the curved portion projecting outward in the car longitudinal direction such that a clearance between the pair of elongated supports increases;

the center pin arrangement space is between the pair of elongated supports by the curved portion;

the cross beam further includes a center pin accommodating structure between the pair of elongated supports and forming the center pin arrangement space; and the center pin accommodating structure includes a longitudinal attaching portion joined to an inner side surface of the curved portion, the inner side surface being opposed to the center pin accommodating structure and having a circular-arc shape, the longitudinal attaching portion including a joining end having a circular-arc shape in a plan view.

12. The railcar bogie frame according to claim 11, wherein:

a vertical size of the joining end of the longitudinal attaching portion is smaller than a vertical size of the inner side surface of the curved portion, the inner side surface being opposed to the center pin accommodating structure; and a welded portion by which the joining end of the longitudinal attaching portion and the curved portion are joined to each other is at the inner side surface of the curved portion.

13. The railcar bogie frame according to claim 11, further comprising:

a gear box receiving seat at the cross beam and supporting a gear box; and a brake receiving seat at the cross beam so as to be located outside the gear box receiving seat in the car width direction, the brake receiving seat supporting a brake, wherein:

the gear box receiving seat projects diagonally from the curved portion outward in the car longitudinal direction and outward in the car width direction; and a welded portion joining the gear box receiving seat and an outer surface of the curved portion between the gear box receiving seat and the outer surface of the curved portion.

14. The railcar bogie frame according to claim 11, wherein the elongated supports are pipes.

15. The railcar bogie frame according to claim 11, further comprising:

a pressing structure on lower surfaces of the pair of elongated supports to press a longitudinal direction middle portions of plate springs from above, the plate springs supporting car width direction end portions of the cross beam, the pressing structure being fixed to the pair of elongated supports.

* * * * *